US006425808B1

(12) United States Patent
Higashikawa

(10) Patent No.: US 6,425,808 B1
(45) Date of Patent: Jul. 30, 2002

(54) HONING TOOL

(75) Inventor: Katsutoshi Higashikawa, Nisshin (JP)

(73) Assignee: Toyo Co., Ltd., Nisshin (JP)

( * ) Notice: Subject to any disclaimer, the term of this patent is extended or adjusted under 35 U.S.C. 154(b) by 0 days.

(21) Appl. No.: 09/962,607

(22) Filed: Sep. 26, 2001

(30) Foreign Application Priority Data

Sep. 28, 2000 (JP) ..... 2000-297363

(51) Int. Cl.[7] ..... B24B 7/00

(52) U.S. Cl. ..... 451/180; 451/61; 451/164; 451/481; 451/505

(58) Field of Search ..... 451/180, 51, 58, 451/59, 61, 124, 164, 168, 462, 464, 470, 481, 504, 505

(56) References Cited

U.S. PATENT DOCUMENTS 5,800,252 A * 9/1998 Hyatt
6,106,383 A * 8/2000 Kalokhe et al.

* cited by examiner

*Primary Examiner*—Timothy V. Eley
*Assistant Examiner*—Willie Berry, Jr.
(74) *Attorney, Agent, or Firm*—Armstrong, Westerman & Hattori, LLP

(57) ABSTRACT

A honing tool has a large-diameter portion thereof provided with a plurality of stone holding recesses arranged radially from the inner bore to the outer edge for slidably holding grinding stones. Each stone holding recess is arranged to form an upper guiding facet and a lower guiding facet at the top side and the bottom side thereof, respectively as well as a couple of side guiding facets at both sides thereof. Also, each grinding stone has an upper sliding facet and a lower sliding facet provided at the top side and the bottom side thereof, respectively for sliding directly on the upper guiding facet and the lower guiding facet. Both sides of the grinding stone are side sliding facets for running directly on the side guiding facets. Moreover, the grinding stone has a tapered facet provided on an upper end thereof at the inner bore side for receiving a pressing force of a tapered rod. Accordingly, the grinding stone is stably held at four sides and can be slid without any jerky movement while being driven for rotating and reciprocating actions as pressing against the inner surface of a workpiece.

4 Claims, 8 Drawing Sheets

Fig. 1 (PROIR ART)

HONING TOOL

BACKGROUND OF THE INVENTION

1. Field of the Invention

The present invention relates to a honing tool attached to the distal end of a spindle (the output shaft) of a honing machine for rotation and forward and backward movements along axial directions to hone the inner surface of a workpiece to be ground.

2. Description of the Related Art

One of conventional honing tools for a honing machine is shown in FIG. 1 where a group of bar-like grinding stones 32 are mounted on the outer side of a cylindrical body 31 so as to extend radially and outwardly. More specifically, the bar-like grinding stones 32 of the honing tool are arranged for moving to and from the outer side of the cylindrical body 31 along radial directions. Each bar-like grinding stone 32 has a couple of arm-like supports 33 and 34 mounted on upper and lower regions thereof and inserted at the other end into corresponding slits provided in the wall of the cylindrical body 31 for joining. The cylindrical body 31 has an inner shaft 35 accommodated in the inner space thereof for upward and downward movements. The inner shaft 35 has two cone tapered portions 36 and 37 thereof arranged for accepting directly with their tapered surfaces the distal ends of the supports 33 and 34 of each bar-like grinding stone 32. As the inner shaft 35 remains urged by a spring or a hydraulic pressure, its cone tapered portions 36 and 37 generate forces for pushing the bar-like grinding stones 32 radially and outwardly from the cylindrical body 31. As a result, the bar-like grinding stones 32 come into direct contact with the inner surface of a workpiece to be ground and when is rotated and moved upward and downward along the axial direction, can hone the inner surface of the workpiece.

However, such a conventional honing tool is disadvantageous in that the bar-like grinding stones 32 which are held by the supports 33 and 34 shaped relatively thin and inserted into the corresponding slits in the wall of the cylindrical body 31 as arranged movable radially about the outer side of the cylindrical body 31 may possibly oscillate forward and backward, leftward and rightward, or upward and downward when rotated and moved upward and downward at the same time during the grinding. This will decline the parallelism between the contact surface of the bar-like grinding stones 32 and the ground surface of the workpiece, thus lowering the straightness and the dimensional accuracy of the workpiece and injuring the bar-like grinding stones 32. Also, in case that the workpiece has lands thereof defined by circumferential grooves in the inner surface thereof, each edge of the lands may be made blunt by the oscillation, hence permitting no highly accurate level of the honing process.

SUMMARY OF THE INVENTION

A honing tool according to the present invention is provided comprising a cylindrical body having a large-diameter portion provided at the distal end thereof; a tapered rod inserted into the inner bore of the cylinder body for sliding movements; and a plurality of grinding stones mounted to the large-diameter portion and urged radially by a pressing force of the tapered rod, wherein the large-diameter portion has a plurality of stone holding recesses provided radially therein from the inner bore to the outer edge for slidably holding the grinding stones, so that an upper guiding facet and a lower guiding facet are formed at the top side and the bottom side of each stone holding recess, respectively while a couple of side guiding facets are formed at both sides of the stone holding recess, and each of the grinding stones held in the corresponding stone holding recesses has an upper sliding facet and a lower sliding facet provided on the top side and the bottom side thereof, respectively for sliding directly on their respective upper and lower guiding facets while it has a couple of side sliding facets provided on both sides thereof for sliding directly on their respective side guiding facets and a tapered facet provided at an upper region thereof at the inner bore side for receiving the pressing force of the tapered rod.

The honing tool may be modified in that the grinding stone is arranged with the lowermost end of its grinding stone tip extending to be flush with the bottom of the large-diameter portion. Also, the large-diameter portion may have four of the stone holding recesses provided radially and spaced at intervals of 90 degrees and the grinding stones are slidably held in their respective stone holding recesses. The large-diameter portion may have a bottom plate fixedly joined by retaining screws to the bottom thereof for serving as the lower guiding facets.

In practice, the honing tool is attached to the distal end of the spindle of a honing machine which can rotate and reciprocate while the tapered rod accommodated in its cylindrical body is joined to the distal end of a pressing shaft installed in the spindle. During the honing process, the honing tool is driven by a rotating mechanism and a high-speed reciprocating mechanism for rotating motion and axial reciprocating motion at small pitches and moved forward by the action of an axially moving mechanism into a workpiece to be ground. As a result, a plurality of grinding stones provided on the large-diameter portion can grind the inner surface of the work piece while being pressed against the same.

At the time, as the grinding stone slidably held in the corresponding stone holding recess in the large-diameter portion is slid directly with its upper sliding facet on the upper guiding facet, with its lower sliding facet on the lower guiding facet, and with its side sliding facets on the side guiding facets at the stone holding recess, it can stably be held at the four sides without any jerky motion. Accordingly, the grinding stone can be driven for repeatedly rotating and reciprocating actions for grinding as being pressed against the inner surface of a workpiece, hence providing favorable accuracy of the roundness, the straightness, and the parallelism on the finished surface of the workpiece.

As the honing process is proceeded, the honing tool moves and grinds the inner surface of the workpiece until its reaches the lowermost end. Because the grinding stones are extended to be flushed at the lowermost end with the bottom of the large-diameter portion of the cylindrical body, they can completely reach the edge of the lowermost end of the workpiece. This permits the workpiece to be ground to the edge of its lowermost end at a higher accuracy of the straightness.

It is an object of the present invention to provide a honing tool which has the foregoing arrangement for stably holding its grinding stones without permitting any vibration or rocking and can thus perform a high level of the honing process at a desired straightness.

DETAILED DESCRIPTION OF THE PREFERRED EMBODIMENTS

Figure 1:
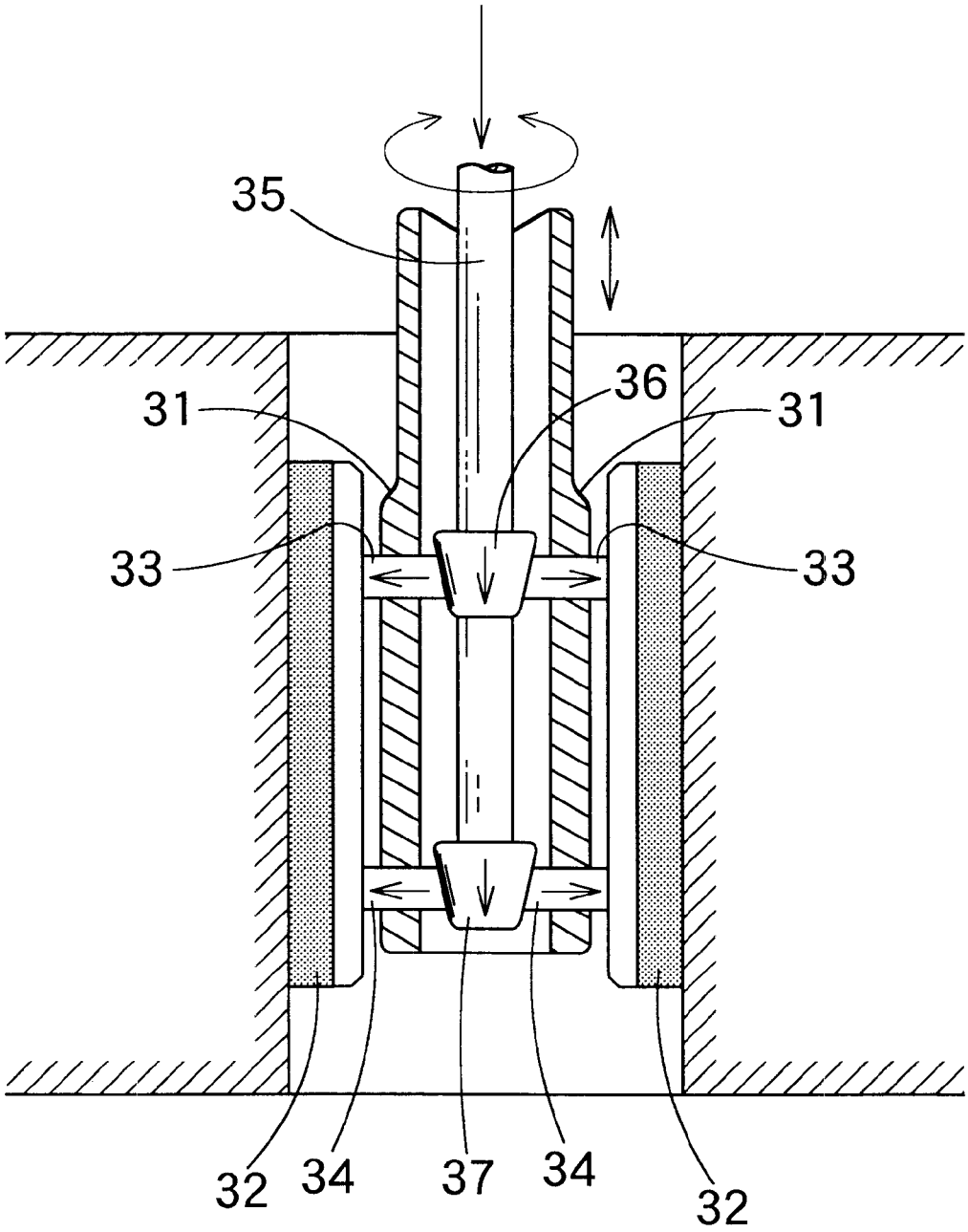
FIG. 1 is an explanatory view of a conventional honing tool.
Figure 2:
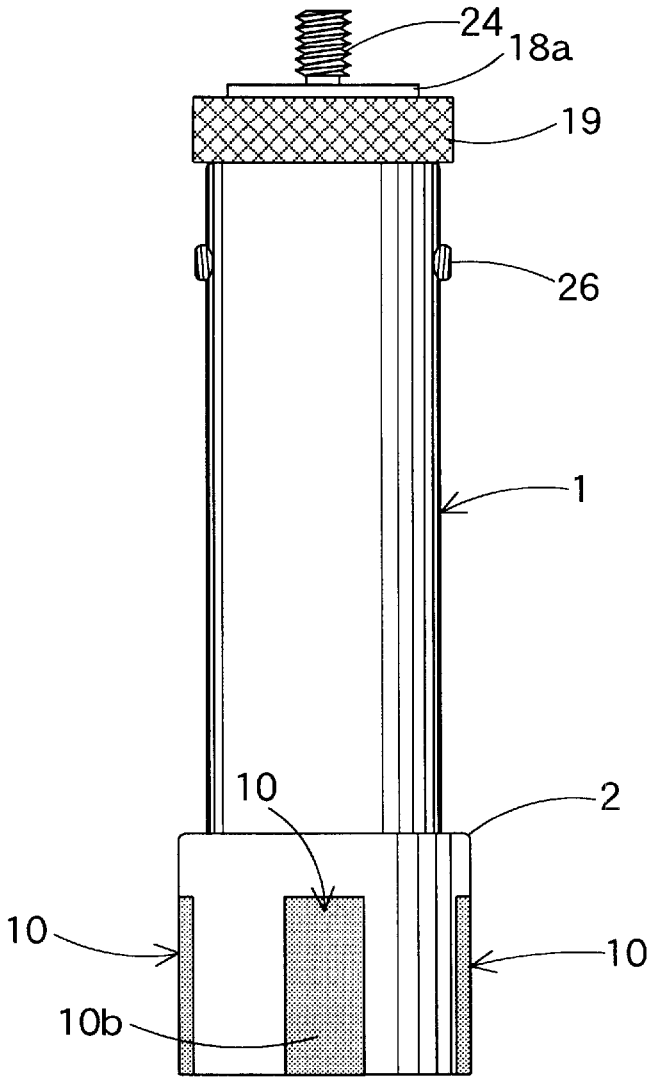
FIG. 2 is a front view of a honing tool illustrating one embodiment of the present invention.
Figure 3:
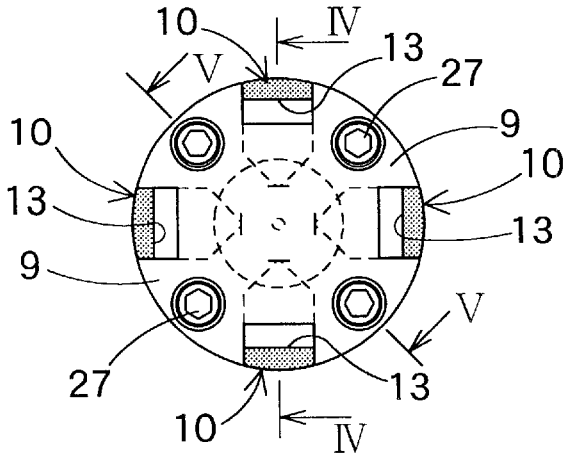
FIG. 3 is a bottom view of the honing tool of the embodiment.
Figure 4:
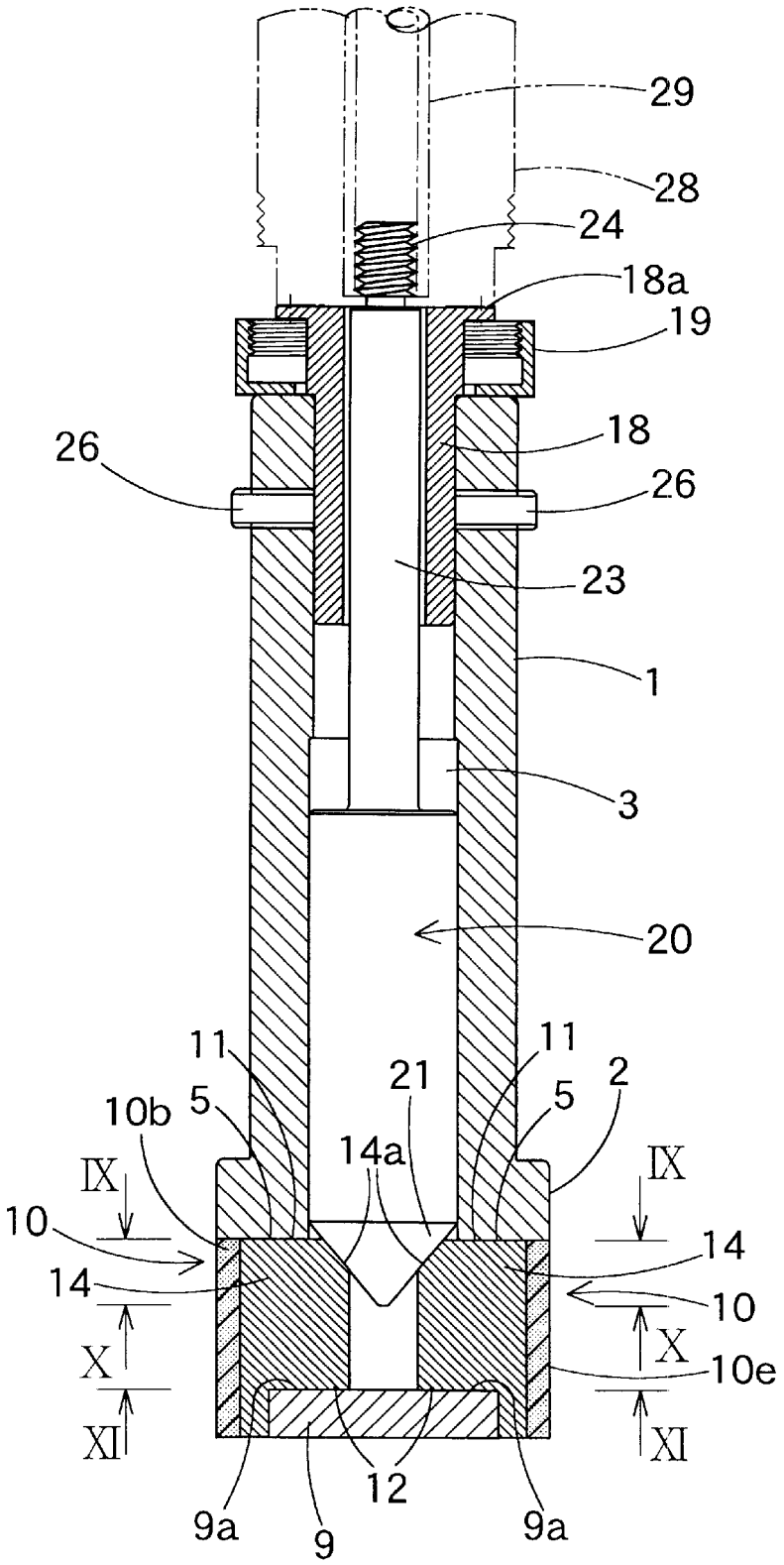
FIG. 4 is a cross sectional view taken along the line IV—IV of FIG. 3.
Figure 5:
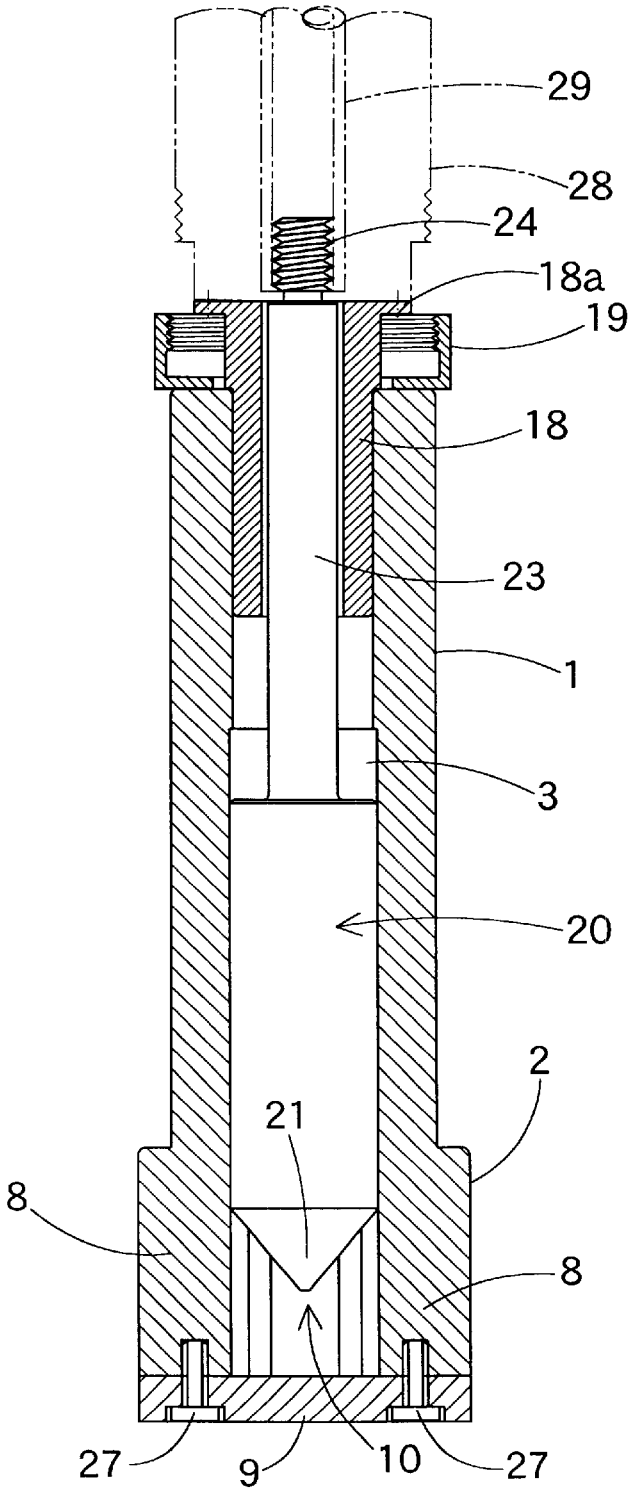
FIG. 5 is a cross sectional view taken along the line V—V of FIG. 3.

The embodiment of the present invention will be described referring to the relevant drawings. FIG. 2 is a front view and FIG. 3 is a bottom view of a honing tool of the embodiment. FIGS. 4 an 5 are cross sectional views of the same. A cylindrical body 1 of the honing tool has a large-diameter portion 2 provided at the distal (lowest) end thereof and an inner bore 3 provided lengthwisely along the axes thereof.

Figure 6:
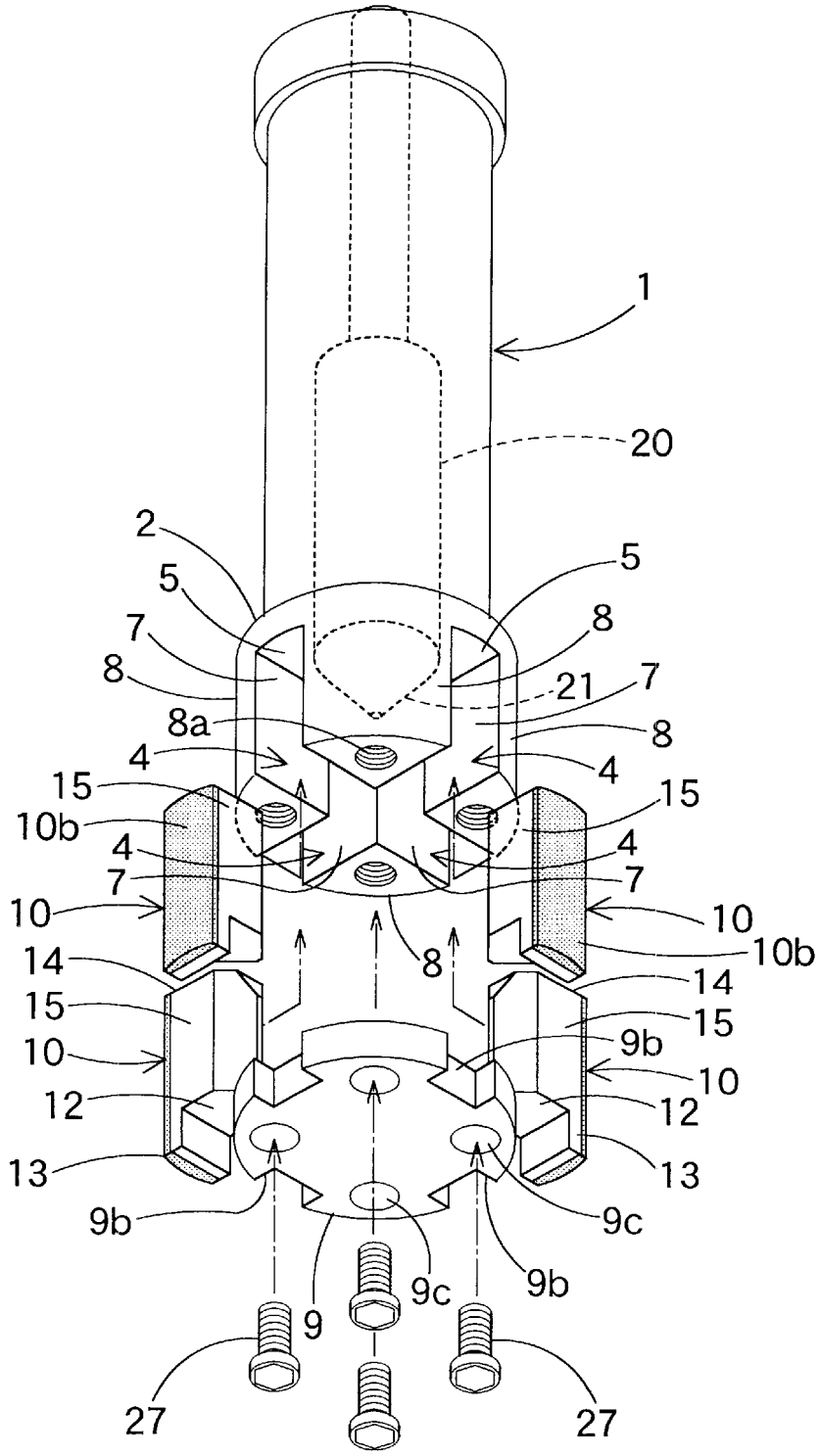
FIG. 6 is an exploded perspective view of the honing tool.

The large-diameter portion 2 at the distal end has four recesses arranged therein radially from the center to form in a cross relationship as spaced at intervals of substantially 90 degrees in the cross section, as shown in the exploded perspective view of FIG. 6. The recesses serve as stone holding recesses 4 while a grinding stone 10, described later in more detail, is radially slidably fitted into each recess 4. Accordingly, four triangle shaped columns 8 of the large-diameter portion 2 are defined by the stone holding recesses 4 arranged radially from the inner bore 3 to the outer surface as best shown in FIG. 6. The triangle shaped column 8 has a couple of guiding side facets 7 provided at both sides thereof for guiding the grinding stones 10 which will be described later. Also, a guiding upper facet 5 is provided at the uppermost of each stone holding recess 4 in the large-diameter portion 2 for guiding the grinding stone 10. The bottom of each triangle shaped column 8 has a screw hole 8*a* provided therein for securing a bottom plate 9 from lower.

Figure 7:
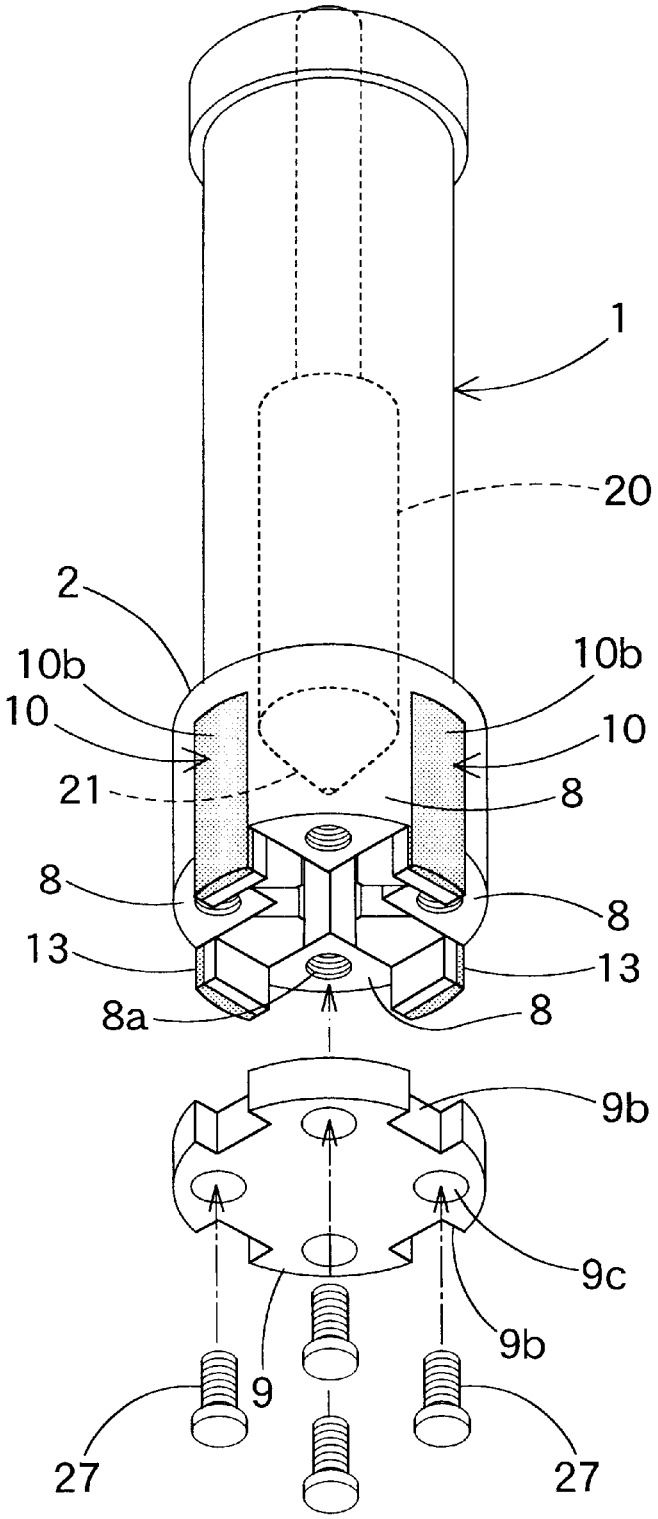
FIG. 7 is an exploded perspective view of the honing tool.
Figure 8:
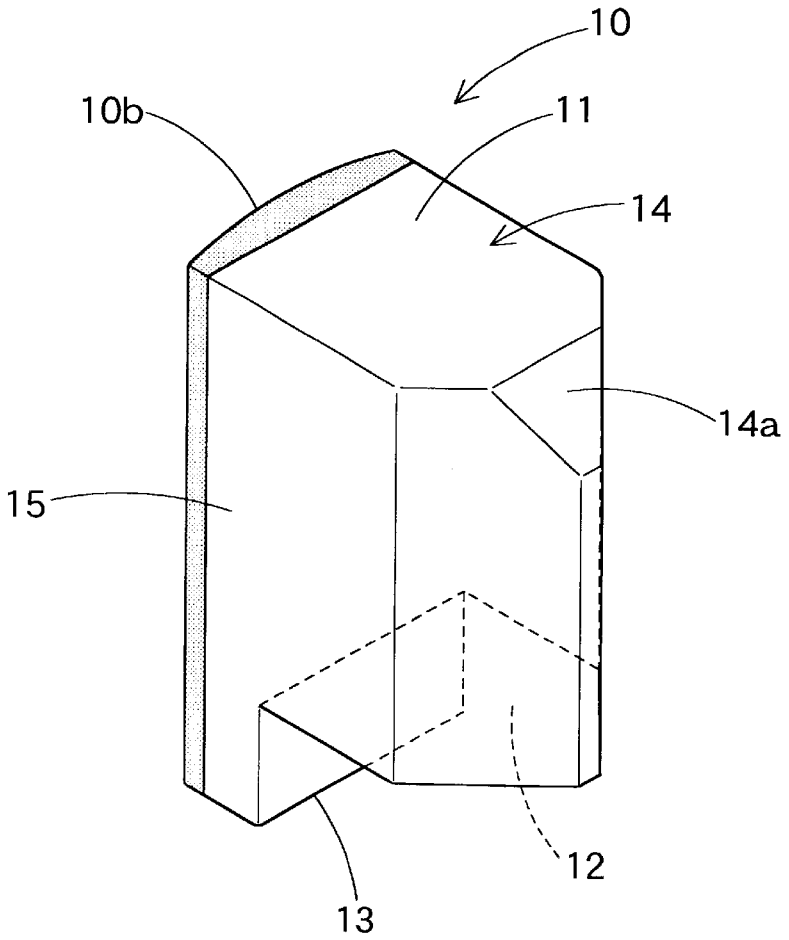
FIG. 8 is a perspective view of a grinding stone 10.
Figure 9:
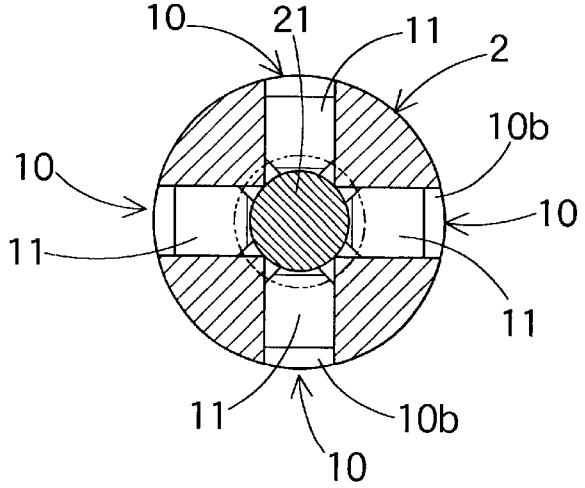
FIG. 9 is a cross sectional view taken along the line IX—IX of FIG. 4.
Figure 10:
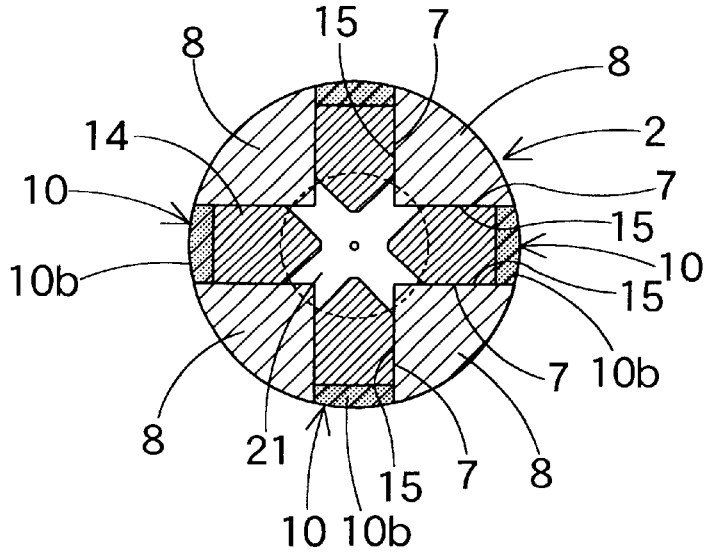
FIG. 10 is a cross sectional view taken along the line X—X of FIG. 4.
Figure 11:
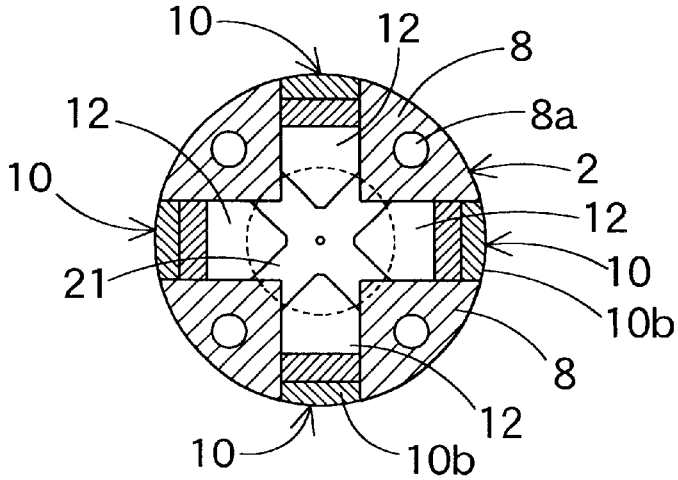
FIG. 11 is a cross sectional view taken along the line XI—XI of FIG. 4

The grinding stone 10 has a grinding stone tip 10*b* bonded to the front side of a substantially trapezoidal base metal 14 thereof as best shown in FIG. 7. The grinding stone tip 10*b* is shaped at its front side of an arcuate configuration which substantially corresponds in shape to the inner surface of the workpiece to be ground. The trapezoidal base metal 14 has a triangle column shape formed by beveling both edges of the rear side of the base metal 14 (at the side of inner bore 3 when installed) and slantly cutting one end of the ridge to form a tapered facet 14*a* which comes in direct contact with the distal end of a tapered rod 20 described later.

The base metal 14 of the grinding stone 10 is arranged of substantially a rectangular parallelepiped of which the top side is an upper sliding facet 11 arranged at a right angle to the axial direction while the bottom side is a lower sliding facet 12 arranged parallel to the upper sliding facet 11. The base metal 14 also has two side sliding facets 15 provided on both sides thereof vertical to the upper sliding facet 11 and the lower sliding facet 12. The grinding stone 10 can thus be fitted into the corresponding stone holding recess 4 in the large-diameter portion 2 of the cylindrical body 1 by sliding with the upper sliding facet 11 and the lower sliding facet 15 directly on their respective upper and lower guiding facets 5 and 7 in the stone holding recess 4. Simultaneously, the lower sliding facet 12 is slid directly on a lower guiding facet 9*a* of the bottom plate 9 which is secured to the distal end of the large-diameter portion 2. As a result, the four grinding stones 10 are held slidable in radial directions in their respective stone holding recesses 4.

Moreover, the grinding stone 10 has a lower projection 13 provided at the lowermost thereof. The lower projection 13 extends downwardly from the lower sliding facet 12 of the base metal 14 and can be fitted into a corresponding rectangular notch 9*b* of the bottom plate 9 so that the lower projection 13 is held slidable in radial directions in the rectangular notch 9*b*.

The bottom plate 9 of a disk shape having the four rectangular notches 9*b* is fixedly secured by retaining screws 27 threaded into screw holes 8*a* to the bottom of the large-diameter portion 2 or the lowermost of the four triangle columns 8. As the bottom plate 9 is secured to the bottom of the large-diameter portion 2, its top provides a cross pattern of the lower guiding facets 9*a* on which the lower sliding facets 12 of the grinding stones 10 are slid directly. As their respective lower projections 13 are slidably held in the corresponding rectangular notches 9*b* of the bottom plate 9, the four grinding stones 10 remain seated on the bottom plate 9 and can be slid radially in the corresponding stone holding recesses 4. The lower projections 13 of the grinding stones 10 held slidably in the corresponding stone holding recesses 4 extend to the lowermost of the tool as is flush with the lower side of the bottom plate 9, as shown in FIGS. 2 and 4.

The tapered rod 20 is movably inserted in the inner bore 3 of the cylindrical body 1. The tapered rod 20 comprises a small-diameter portion 23, a round column portion provided beneath the small-diameter portion 23, and a tapered cone 21 of a conical shape provided at the distal end of the round column portion. The small-diameter portion 23 has a thread 24 provided on the upper end thereof. The small-diameter portion 23 is inserted into an inner tube 18 fitted into the upper end of the inner bore 3. The inner tube 18 is inserted from above into the inner bore 3 and secured by retailing screws 26 to the cylindrical body 1. The inner tube 18 has a flange 18*a* provided at the uppermost end thereof. A cap nut 19 is loosely provided to surround the flange 18*a*. The flange 18*a* has fitting holes provided therein for accepting pins of a spindle 28. As the cap nut 19 is tightened, the honing tool is joined to the lowermost end of the spindle 28.

Accordingly, while the grinding stones 10 are slidably held in the corresponding stone holding recesses 4 provided radially in the large-diameter portion 2 of the cylindrical body 1, the tapered rod 20 remains accommodated in the inner bore 3 of the cylindrical body 1 with its tapered cone 21 seated directly on the tapered facet 14*a* of the base metal 14 of each grinding stone 10. When the tapered rod 20 is urged downwardly, it presses and moves the four grinding stones 10 outwardly in the radial directions.

The honing tool is fixedly joined by the interaction between the flange 18*a* and the cap nut 19 to the lowermost end of the spindle 28 of the honing machine. Simultaneously, the uppermost end of the tapered rod 20 is fixedly joined to the distal end of a pressing shaft 29 provided inside the spindle 28. A common honing machine can be used which comprises at least a rotating mechanism for rotating the spindle 28 together with the pressing shaft 29, a high-speed reciprocating mechanism for reciprocating the spindle 28 along its axial directions at a high speed and a smaller pitch, an axially driving mechanism for moving the spindle 28 (upward and downward) along its axial directions at a slow speed, and a press-down mechanism for pressing down the pressing shaft 29 by means of a spring or a hydraulic pressure.

When the honing machine is started for honing process, its spindle 28 is driven to rotate and reciprocate at a small pitch along the axial directions. Then, the honing tool is slowly advanced into the inner space of a cylindrical workpiece while a grinding fluid is injected therein. As the four grinding stones 10 on the large-diameter portion 2 come into direct contact with the inner surface of the workpiece, the pressing shaft 29 is pressed down by the press-down mechanism to lower the tapered cone 21 of the tapered rod 20. As a result, the four grinding stones 10 is urged via the tapered facets 14*a* of the base metals 14 by the pressing force of the tapered rod 20 thus biasing outwardly and radially (for increasing the diameter). This causes the grinding stone tips 10*b* of the grinding stones 10 to slightly extend outwardly from the outer side of the honing tool and press against the inner surface of the workpiece. As the grinding stone tips 10*b* are driven by the rotating and reciprocating movements, they grind the inner surface of the workpiece.

During such honing process, the grinding stones 10 on the large-diameter portion 2 remain stably held in their respective stone holding recesses 4 as each supported at the four sides. More specifically, each the grinding stone 10 is supported with its upper sliding facet 11 running directly on the upper guiding facet 5 of the stone holding recess 4, its lower sliding facet 12 running directly on the lower guiding facet 9*a* of the bottom plate 9, and its two-side guiding facets 15 running directly on the side guiding facets 7 of the two adjacent triangle columns 8. In fact, four surfaces of the base metal 14 of the grinding stone 10 can slidably be held at the four sides in the corresponding stone holding recess 4.

While the grinding stone 10 remains held stably with its stone tip 10*b* pressing against the inner surface of the workpiece, it can repeatedly rotate and reciprocate, thus contributing to the higher precision of the roundness, the straightness, and the parallelism of the workpiece.

As the honing process proceeds, the honing tool is advanced further into the inner space of the workpiece until it gradually reaches the lowermost end. Since the lower projection 13 of the grinding stone 10 is flushed with the bottom of the large-diameter portion 2 or the lower side of the bottom plate 9, it can certainly reach the lowermost end or the edge of the inner surface of the workpiece. This allows the workpiece to be ground to the lowest edge of its inner surface at a favorable accuracy of the straightness and precision. Accordingly, a clearance groove provided in the lowermost end of a workpiece for permitting a conventional honing tool to grind the lowest edge of the inner surface of the workpiece will be unnecessary. Since the grinding stone 10 has the grinding stone tip 10*b* structured so as to be bonded to the base metal 14 which is sized larger and shaped to have a rectangular front side as compared with a conventional honing tool, it can be increased in the physical strength and thus minimized in the injury of the grinding stone.

While the number of the grinding stones 10 provided on the large-diameter portion 2 is four in the embodiment, it may be three or five arranged circumferentially at equal intervals and held in the corresponding stone holding recesses 4. Although the bottom plate 9 is prepared separately and joined to the large-diameter portion 2 by the retaining screws 7, it may be fabricated integral with the large-diameter portion 2.

As set forth above, the honing tool of the present invention allows each grinding stone to be stably held at four sides and slid without any jerky motion while being driven for rotating and reciprocating actions for grinding as being pressed against the inner surface of a workpiece, hence providing favorable degrees of the roundness, the straightness, and the parallelism on the finished surface of the workpiece. Also, as the grinding stones are arranged to be flushed at the lowermost end with the bottom of the large-diameter portion of the cylindrical body, they can completely reach the edge of the lowermost end of the workpiece. This permits the workpiece to be ground to the edge of its lowermost end at a higher accuracy of the straightness.

What is claimed is:

1. A honing tool comprising:

(a) a cylindrical body having a large-diameter portion provided at the distal end thereof;

(b) a tapered rod inserted into the inner bore of the cylinder body for sliding movements; and (c) a plurality of grinding stones mounted to the large-diameter portion and urged radially by a pressing force of the tapered rod, wherein the large-diameter portion has a plurality of stone holding recesses provided radially therein from the inner bore to the outer edge for slidably holding the grinding stones, so that an upper guiding facet and a lower guiding facet are formed at the top side and the bottom side of each stone holding recess respectively while a couple of side guiding facets are formed at both sides of the stone holding recess, and each of the grinding stones held in the corresponding stone holding recesses has an upper sliding facet and a lower sliding facet provided on the top side and the bottom side thereof, respectively for sliding directly on their respective upper and lower guiding facets while it has a couple of side sliding facets provided on both sides thereof for sliding directly on their respective side guiding facets and a tapered facet provided at an upper region thereof at the inner bore side for receiving the pressing force of the tapered rod.

2. A honing tool according to claim 1, wherein the grinding stone is arranged with the lowermost end of its grinding stone tip extending to be flush with the bottom of the large-diameter portion.

3. A honing tool according to claim 1, wherein the large-diameter portion has four of the stone holding recesses provided radially and spaced at intervals of 90 degrees and the grinding stones are slidably held in their respective stone holding recesses.

4. A honing tool according to claim 1, wherein the large-diameter portion has a bottom plate fixedly joined by retaining screws to the bottom thereof for serving as the lower guiding facets.

* * * * *